US005200735A

United States Patent [19]

Hines

[11] Patent Number: 5,200,735

[45] Date of Patent: Apr. 6, 1993

[54] WEATHER PROTECTED PORTABLE SECURITY SYSTEM FOR IN-FIELD USE

[76] Inventor: Thomas N. Hines, 1025 Bayside Dr., Palatine, Ill. 60067

[21] Appl. No.: 673,259

[22] Filed: Mar. 20, 1991

Related U.S. Application Data

[63] Continuation of Ser. No. 378,020, Jul. 11, 1989, abandoned.

[51] Int. Cl.[5] ..... G08B 13/00; G08B 15/00; G08B 25/00

[52] U.S. Cl. ..... 340/539; 340/691; 340/693

[58] Field of Search ..... 340/539, 571, 566, 568, 340/521, 546, 545, 554, 567, 691, 693, 652

[56] References Cited

U.S. PATENT DOCUMENTS

| | | | |
|---|---|---|---|
| 883,335 | 3/1908 | O'Connor . | |
| 3,618,067 | 11/1971 | DeVale et al. | 340/282 |
| 3,742,478 | 6/1971 | Johnson | 340/262 R |
| 3,781,861 | 12/1973 | Adler, Jr. et al. | 340/280 |
| 3,824,540 | 7/1974 | Smith, II | 340/63 |
| 3,852,740 | 12/1974 | Haymes | 340/539 |
| 3,914,756 | 10/1975 | Seyk | 340/280 |
| 3,925,763 | 12/1975 | Wadhwani et al. | 340/539 |
| 3,938,124 | 2/1976 | Way et al. | 340/280 |
| 3,961,323 | 6/1976 | Hartkorn | 340/280 |
| 4,211,995 | 7/1980 | Smith | 340/63 |
| 4,222,032 | 9/1980 | Speer | 340/63 |
| 4,247,846 | 1/1981 | Zedler | 340/539 |
| 4,274,077 | 6/1981 | Feiger | 340/63 |
| 4,319,228 | 3/1982 | Daniels | 340/521 |
| 4,358,756 | 11/1982 | Morel et al. | 340/539 |
| 4,622,538 | 11/1986 | Whynacht et al. | 340/539 |
| 4,656,463 | 4/1987 | Anders et al. | 340/521 |
| 4,661,804 | 4/1987 | Abel | 340/539 |
| 4,691,195 | 9/1987 | Sigelman et al. | 340/545 |
| 4,742,336 | 5/1988 | Hall et al. | 340/546 |
| 4,764,757 | 8/1988 | DeMarco et al. | 340/539 |
| 4,908,604 | 3/1990 | Jacob | 340/539 |

*Primary Examiner*—Glen R. Swann, III

*Attorney, Agent, or Firm*—Price, Heneveld, Cooper, DeWitt & Litton

[57] ABSTRACT

A mobile security system includes remote sensor units each having a condition-responsive sensor of a variety of types (motion, intrusion, loop, heat, water, etc.) and a transmitter for sending a signal to a master control to report a sensed condition. The master control includes a receiver for intercepting signals from the remote sensors and a transmitter for sending a signal to a remote alarm unit in response to a sensed condition. The remote alarm unit can be positioned to provide a sound to discourage an intruder or it can be positioned to alert a guard that an intruder or other condition has been sensed. One of the remote sensors is disposed in a pocket on the bottom side of a tarp which is used to cover goods to protect them from weather and theft. Any attempt to loosen or move the tarp to gain access to the goods will cause an alarm signal to be generated. The master control unit can activate a remote audible alarm, dial a telephone number to report, activate a cellular telephone to report, or activate a long range transmitter to send a signal to a remote second master control to report. All of the units of the portable security system are contained in weatherproof housings so that the entire system can be set up outdoors, if necessary.

15 Claims, 4 Drawing Sheets

WEATHER PROTECTED PORTABLE SECURITY SYSTEM FOR IN-FIELD USE

This is a continuation of co-pending application Ser. No. 07/378,020 filed on Jul. 11, 1989, now abandoned.

BACKGROUND OF THE INVENTION

The present invention relates to a portable modular security system for use in in-field applications.

Many security systems are currently available for use in permanent installations in protecting homes and buildings from unauthorized entry, theft, and vandalism. For the most part, these systems use permanently installed sensors on windows, doors, and affixed in the corners of rooms to detect entry or motion. Many of the systems also include smoke and fire detectors which can provide a local alarm as well as sending an alarm to a central control station.

When the need arises to protect a construction site or an oil or gas field from theft or vandalism, it is the usual practice to hire a guard service since no permanent installation is available to support an electronic security system. While a guard system does provide a measure of protection, the guards can only be in one place at a time. While the guard patrols the site and stops at key stations to record on a clock when the guard was at that spot, the remainder of the site remains unprotected. This is a particular problem in a large construction site where supplies and equipment are scattered about the site and not clearly visible to the guard from any one location.

SUMMARY OF THE INVENTION

The modular portable, mobile security system of the present invention is meant to overcome the aforementioned shortcomings. Through the use of this system, sensors can be placed on valuable pieces of equipment and on supplies about a construction site, an oil and gas field, or in an industrial plant or factory, or indeed many other locations, all collectively referred to as "in-field sites" in order to protect the supplies, equipment and various goods from theft and vandalism. The security system can be brought to the site in padded carrying cases and can be then set up about the site in a minimum of time. Since the system employs radio transmission and reception, there is no need to install wiring about the site. The system can be set up in a manner of minutes and can then be left unattended. The master control unit can be set up in an office at the construction site where it can be attended, or the unit is adapted to send a signal to a remote central office for appropriate action.

In one form, the invention is a weather-protected portable security system comprising an alarm condition sensor and a first radio transmitter in a first weather-protected housing. The first transmitter sends a signal representative of an alarm condition to a remote receiver. A second weather-protected housing is included and contains a radio receiver for receiving the signal from the first transmitter, a controller for responding to the received signal, and a second transmitter activated by that signal from the controller for sending a signal to a remote alarm device. Further, a remote alarm device is included in a third weather-protected housing including a radio receiver for receiving the activating signal from the second transmitter and for sounding an audible alarm in response to the signal.

In preferred forms of the invention, the controller can provide a signal to at least one of a digital autodialer, a cellular telephone, or a high-powered transmitter to signal an alarm condition in various ways. These devices can be separately housed in other weather-protected containers.

In another aspect of the invention, a remote emergency condition sensor is provided including a condition-responsive device for producing an electrical signal upon the sensing of a condition, a transmitter responsive to the signal from the condition-responsive device for sending a signal to a remote receiving site to advise the receiving site of the condition sensed, a power source for the condition-responsive device and said transmitter, a weatherproofed housing for containing said condition-responsive device and said transmitter, a power source to enable the emergency condition sensor to be positioned outdoors, and an antenna for the transmitter mounted on the weatherproof housing.

In yet other aspects of the invention, an alarm unit is provided forming a part of a portable security system to provide an audible alarm including a weather-protected housing, an antenna disposed on the housing for accepting a signal from a remote source and for conveying the signal into a weather-protected housing, a receiver in the housing for receiving an activating signal from the antenna from a master control unit, a driver activated by the signal from the receiver, and an audio device responsive to the signal from the driver to produce a loud sound.

Further, a cover may be provided to protect goods from theft including a sheet of material for covering the goods to be protected, at least one covered pocket disposed on the sheet of material, at least one motion sensor in the pocket, the motion sensor including a sensing device for detecting movement of the sheet of material and for generating an electrical signal in response to such movement A transmitter is also provided for broadcasting a signal to a remote receiver in response to the electrical signal from the sensing device along with a power source for the sensing device and transmitter. A weatherproof housing contains all of the sensing device, transmitter and power source. Further, an antenna for the transmitter is disposed on the housing.

The invention, both as to its organization and method of operation, together with further advantages thereof, will best be understood by reference to the following detailed description taken in connection with the accompanying drawings.

DETAILED DESCRIPTION OF THE PREFERRED EMBODIMENT

Figure 1:
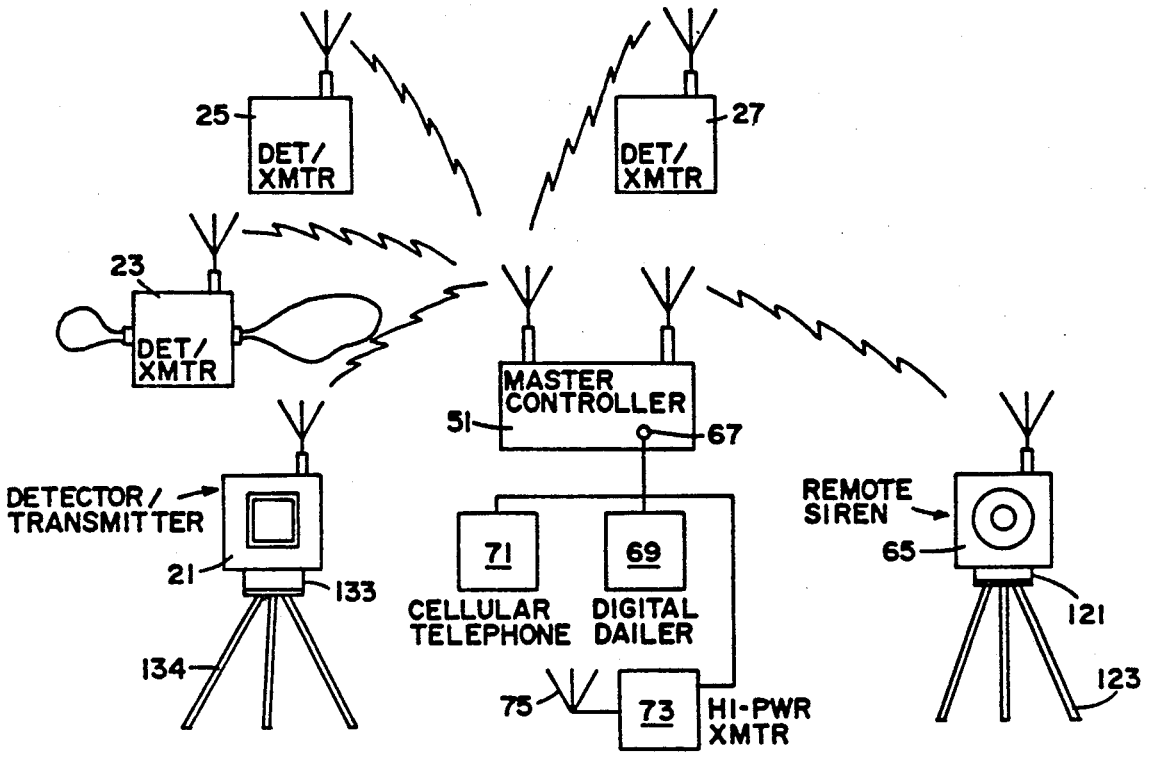
FIG. 1 is a simplified block diagram of the modular security system.

Referring to FIG. 1, a representative security system of the present invention is shown. The system includes sensor/transmitter units 21, 23, 25, and 27 which can be positioned about a construction site, for example, to protect supplies, equipment and various goods from theft and vandalism. The system is also useful in industrial plants, factories, shops and the like. The sensor/-transmitter units 21-27 can be equipped with appropriate sensors to detect motion or vibration, movement of a person, opening of a door or window, and the unfastening or loosening of a tarp over goods to be protected. Industrial or other type sensors can also be used such as those to sense temperature of an object, humidity, water level, fire and/or smoke, toxic gas, or dry contact closure or switch-type sensors. Each of the sensors included in the units 21-27 is commercially available. Motion, shock, and infrared sensing of an intruder devices are available from Sentrol, Inc. of Portland, Or. Another source of motion sensors is C & K Systems, Inc. of San Jose, Ca, which provides a combined microwave and infrared sensor for motion detection.

Figure 3:
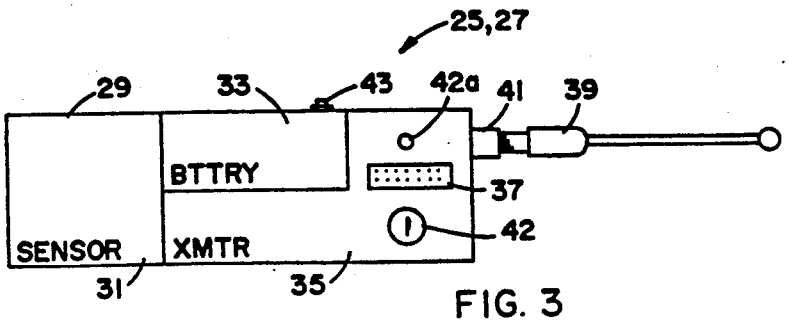
FIG. 3 is an elevation view partially in section of a sensor/transmitter.

Each of the sensors 23, 25, and 27, referring to FIG. 3, can be mounted in a rugged aluminum box 29 FIG. 3 which is tightly sealed to protect the contents from weather and mechanical shock. In'ruder sensor 21 is mounted in a slightly different, weatherproof housing and is more fully described below in connection with FIG. 7. The aluminum housing 29 contains the appropriate sensor element 31, a battery 33, a transmitter 35, and a digital programming switch or dip switch 37 which is used to encode the transmitter 35. A suitable antenna 39 is fastened by means of an SO-259 connector 41 to the aluminum housing. A key switch 42 may be provided in addition to switch 3 to empower the sensor, if desired. The batteries used to power the sensor/transmitter can be either replaceable or rechargeable batteries. A light emitting diode 42*a* may be provided on each sensor 25, 27 to indicate low electrical charge or power in battery 33. For convenient recharging of the batteries 33, a pair of exposed connectors 43, only one of which is shown, are mounted on the side of the housing. The housing is adapted to be charged by either connection to a battery charger or by simply dropping the unit into a drop-in-place battery charger.

Since the portable security system of the present invention is meant to be used in the field and to cover a large area, the transmitters used should be capable of sufficient output power to be able to consistently send a signal to a remote receiver. The preferred transmitters are made by Linear Corporation of Carlsbad, Ca, and belong to the 160 Series Mid-Range Products which are capable of a range of three-quarter mile to five miles. Suitable transmitters are the MR161T, MR164T, and MR168T. Each of these transmitters is capable of being digitally encoded by a dip switch 37 in order to provide identification of the signal and in turn the conditions sensed by the condition-responsive device 31. The sensors/transmitter packs 21-27 can be positioned about a construction site on equipment or supplies and can broadcast a signal indicating the alarm condition to a master control unit 51.

Figure 3A:
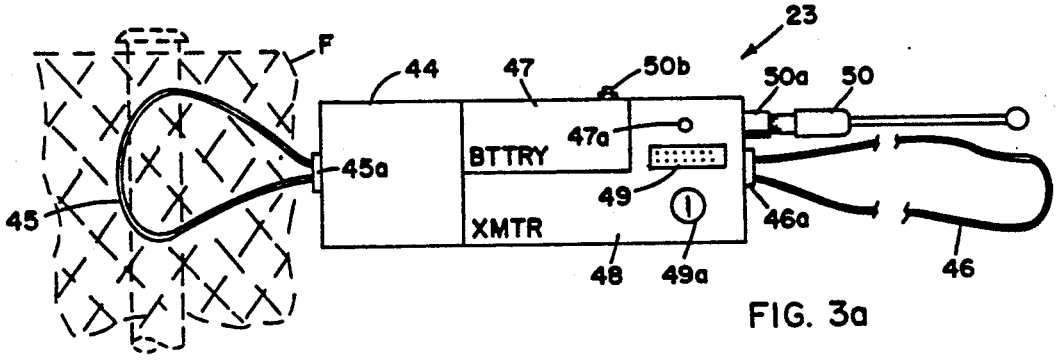
FIG. 3A is a simplified elevation view partially in section of a loop-type sensor/transmitter.

As shown in FIG. 3A, sensor 23 is a loop-type sensor unit designed to generate a signal should either of the electrified loops connected to its ends be pulled from its housing or be cut or broken. Loop sensor 23 is mounted in a rugged aluminum box 44 similar to box 29 which is tightly sealed to protect the contents from weather and mechanical shock. Housing 44 contains appropriate electrical circuitry connected to a pair of different length, braided wire, electrically conductive cable loops 45, 46. Loops 45, 46 are joined to housing 44 by connectors 45*a*, 46*a*, respectively, which are, in turn, electrically connected to the circuit within the housing. The loops are sheathed in a rubber, polymeric or other insulating covering to prevent electrical shocks when touched. Also included within housing 44 are a battery 47 for electrically powering the circuit and loops, a transmitter 48, and a digital programming switch or dip switch 49 which is used to encode transmitter 48. The battery 47, transmitter 48 and switch 49 are each similar to battery 33, transmitter 35 and dip switch 37 described above. A key switch 49*a* may also be provided in addition to switch 49 to empower the sensor, if desired. A suitable antenna 50 is fastened by means of an SO-259 connector 50*a* to the aluminum housing 44. The batteries used to power the loop sensor/transmitter 23 can be either replaceable or rechargeable batteries. A light emitting diode 47*a* may be provided on loop sensor 23 to indicate low electrical charge or power in battery 47. For convenient recharging of the batteries 47, a pair of exposed connectors 50*b*, only one of which is shown, are mounted on the side of the housing. The housing is adapted to be charged by either connection to a battery charger or by simply dropping the unit into a drop-in-place battery charger.

Loops 45 and 46 are provided in different lengths to enable the loop sensor/transmitter 23 to be connected to a fixed object such as a fence F (FIG. 3A) via shorter loop 45 and to extend the longer loop 46 through various pieces of machinery such as bulldozers, or various bags, cases and the like, the tampering with or theft of which is designed to be prevented. When connectors 45*a*, 46*a* are removed from housing 44, one end of loop 45 or 46 may be released from the connector, inserted through the fence or the goods to be protected and reinserted in the connector 45*a* or 46*a* and reinserted in the case. The cutting of cables 45 or 46 or the vigorous pulling of the loops 45, 46 sufficient to remove connectors 45*a*, 46*a* from housing 44 will activate the loop sensor circuitry and generate a signal which is transmitted by transmitter 48 to the master control unit 51 as described below.

Figure 2:
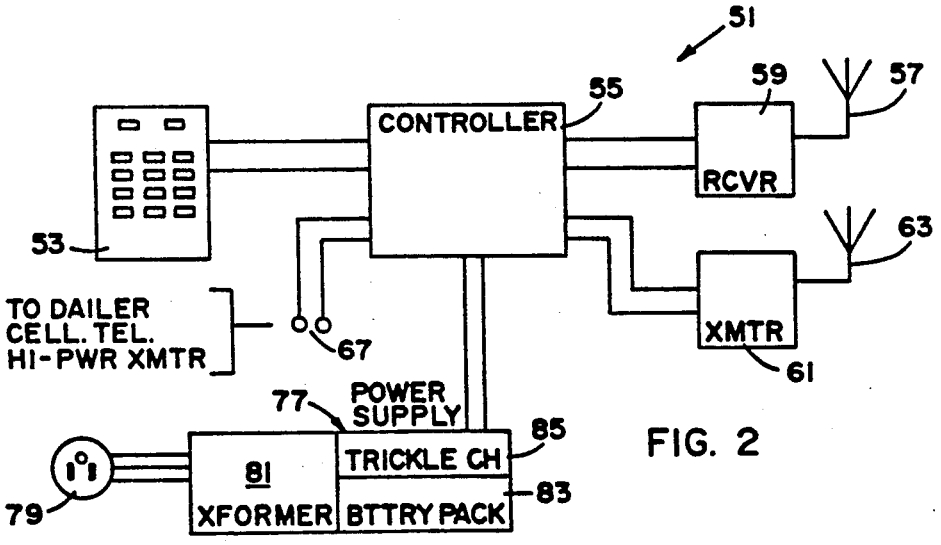
FIG. 2 is a block diagram of the master control unit.

Referring to FIG. 2, the master control station has a digital keypad 53 for powering up the equipment, for testing and for providing a digital input to the controller 55. The master control is equipped with a receiving antenna 57 and a digitally encoded receiver 59. The preferred receiver, like the transmitter, is made by Linear Corporation of Carlsbad, Ca. A 160 Series receiver is preferred such as the MR161R, MR164R, and MR168R. Each of these receivers is adapted to receive and decode one, four, or eight channels. It is possible, then, with the eight-channel unit to have eight different sensor transmitters in the field monitoring eight different sites. It is also possible to modularly increase the number of receivers to correspondingly increase the number of channels being monitored. The output of the receiver 59 is sent to the controller 55 which is a small microprocessor controlled unit which is adapted to take input signals from the keypad and use these signals to control the function of the master control. The controller 55, on receipt of an alarm signal, is adapted to activate transmitter 61 to send a signal from antenna 63 to the remote siren 65. The controller also has an output 67 which can be used to program and activate a digitally controlled autodialer 69 which can be connected by suitable conductors to a central monitoring station, the police station, or a fire station. The Model 113A digital communicator available from Fire Burglary Instruments, Inc. of Hauppauge, N.Y., is the preferred digital autodialer. The output 67 can also supply a signal to a cellular telephone 71 which would enable the unit to be completely isolated in the field while still being able to dial up and transmit a signal to a central monitoring station, police, and/or fire station.

The master control can also provide a signal to a high-power transmitter 73 to send a signal to a receiver at a remote central station. The transmitter 73 can be digitally encoded and operate at 25 to 50 watts and send a signal by means of an antenna 75 to a remote station approximately twenty miles away. Using the portable high-powered transmitter along with the portable monitoring system, it is possible to set the system up at a remote installation, for example, an oil or gas site, and have it monitor alarm conditions and broadcast a signal several miles to a receiving site from which suitable action can be taken. For example, if the condition-responsive devices are set up to monitor fire, smoke, or intrusion, the central site many miles away can be alerted. It is also possible to connect the receiver 59 into an existing security system to take advantage of in-place power and telephone lines.

The master control 51 is also equipped with a power supply 77 which is adapted to be connected to the conventional AC power source through a cable and plug 79. The power supply contains a step-down transformer 81, a rechargeable battery pack 83, and a rectifier trickle charger 85 to convert the AC supply voltage to DC for operation of the master control unit and provide a trickle charge for the rechargeable batteries 83. The latter unit is preferably the Model CH-12 available from Moose Products, Inc. of Hickory, N.C. Similar units from other suppliers should be acceptable. It can be seen from the above description that the entire system is portable including the master control unit and can be taken off line and isolated from conventional power and telephone wiring.

Figure 4:
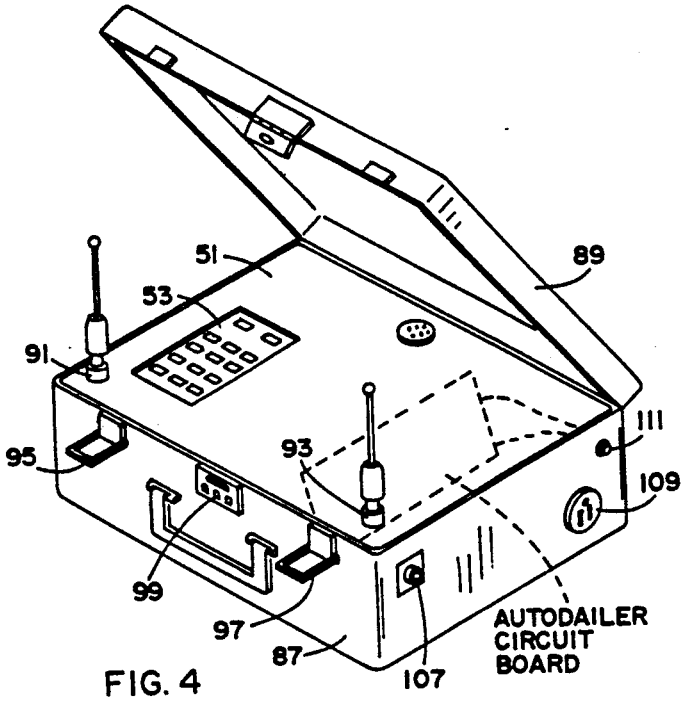
FIG. 4 is a perspective view of the master control unit.
Figure 5:
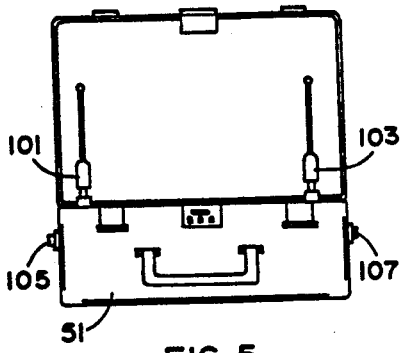
FIG. 5 is an elevation view of the master control unit.

Now referring to FIGS. 4 and 5, the master control 51 is shown mounted in a heavy duty tool case. Since the portable security system is primarily intended for use in the field or in remote applications, each of the components is carefully designed to be weather-protected. Also, no attempt is made to disguise the units or camouflage the units. While this can be done and is certainly within the scope of the invention, it is intended that the units be painted with bright colors to clearly point out that a security system is in place. For example, the master control 51 would preferably be painted a bright yellow or orange. The master control is mounted in the case 87 having a lid 89. As shown in FIG. 4, the lid is open so that the operator of the security system can have access to the digital keypad 53. Also included in the case on the same surface as the keypad are a pair of coaxial connectors 91 and 93 for mounting the receiving and transmitting antennas respectively. The lid 89 and the case 87 are equipped with latches 95 and 97 and a lock 99 having a finger-operated combination lock.

When setting this system up and referring to FIG. 5, a receiving antenna 101 would be mounted on coax fitting 91, and a transmitting antenna 103 would be mounted on coax fitting 93. The operator can then activate the system using the digital keypad. The system is equipped to be under control of the keypad 53. The power is turned on to the system by entering a code into the pad which then is decoded through the controller 55 to actuate and power up the system. All of the programming for the digital autodialing circuit and for the cellular telephone and high-powered transmitter are entered through the digital keypad. The receiver 59 and the transmitter 61 are tuned or set to the respective receiving and transmitting frequencies through the dip switches incorporated in each unit. The frequency coding can also be done through the keypad 53 and the controller 55 which would provide output signals in parallel with the dip switches. After the master control has been powered up and tested, the antennas 101 and 103 can be disconnected from the coax fittings inside the case to coax fittings 105 and 107 mounted on the side of the case. A suitable right angle coaxial adapter can be used so that the antennas point in a vertical direction. With the antennas mounted on the side of the case, the lid 89 can be closed and locked through the combination lock 99 to prevent access to the digital keypad. To increase the receiving and transmitting range of the master control unit, suitable outdoor antennas can be mounted on the roof of the building or enclosure which are then connected to the master control unit with coaxial cable.

On the side of the case 87 are provided connectors 109 for the AC power input and a connector 111 for a conventional telephone cable. The connector 111 provides an output to the autodialer 69, cellular telephone 71, and high-powered transmitter 73. Each of the latter units would be mounted in its own weatherproof container to be consistent with the overall concept of the portable security system. Since digital autodialers are readily available on a printed circuit board, it is within the scope of the present invention to also mount the digital autodialer within the cabinet 87. The printed circuit board could have a conventional edge connector to plug into a suitable socket in the cabinet or could be permanently mounted within the cabinet with suitable hardware and standoff fittings.

Figure 6:
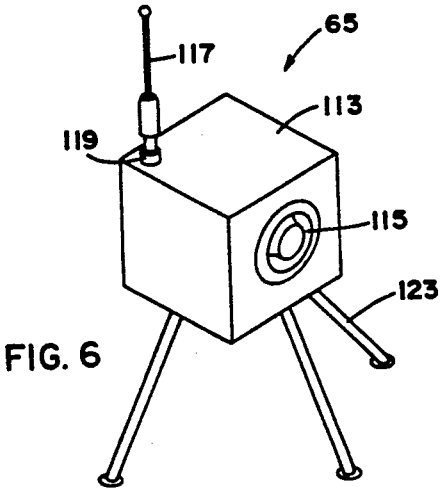
FIG. 6 is a perspective view of a remote siren pack.

Again referring to FIG. 1, when one of the remote sensors 21–27 senses an alarm condition through its condition-responsive device, it transmits a digitally coded signal to the antenna 57 (FIG. 2) mounted on the master control unit 51. The signal is processed in the master control, and a signal is then transmitted from the antenna 63 to the remote alarm unit 65. As shown in FIG. 6, the alarm unit has a weather-tight housing 113 so that it can be mounted outdoors exposed to the weather. Within the cabinet 113, a receiver is mounted similar to the receiver in the master control. However, it is necessary to receive only one digitally coded channel or signal. The signal received by the receiver then activates a siren driver which, in turn, drives siren 115 positioned on a face of the cabinet 113. The siren driver and siren speaker are available from Moose Products Inc., Hickory, N.C. The MPI-11 or JDS-100 siren driver can be used along with a suitable loudspeaker. The remote alarm unit has its own receiving antenna 117 mounted on a fitting 119. A mechanical coupling 121 is mounted on the bottom of the housing 113 to enable the remote alarm unit to be mounted on a tripod 123, as shown in FIG. 1, or the remote alarm unit can be merely positioned on a surface.

When setting up the entire portable security system, the remote alarm unit can be positioned near the equipment or supplies to be protected, or it can be positioned near a guard station or a station where personnel are present on a twenty-four hour basis. In the former case, a loud siren sound can be used to frighten off thief or vandal while in the latter case, the alarm unit can be used to alert the crew that a thief or vandal is present at the site being monitored.

Figure 7:
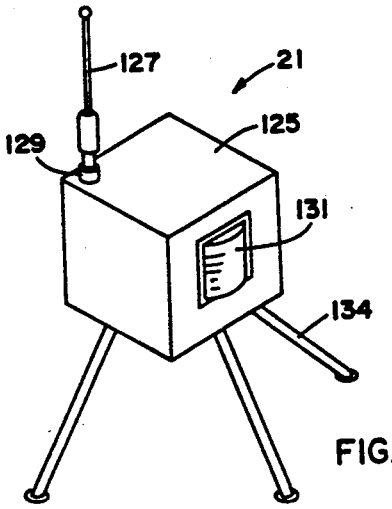
FIG. 7 is a perspective view of a motion sensor for use with the system.

In FIG. 7, there is shown a remote motion detector 21 which is mounted in the cabinet 125 similar to cabinet 113. The motion detector has an antenna 127 mounted on a fitting 129 on the top of the housing. On the face of the housing is mounted a window 131 through which microwave signals are sent and received to detect motion and also positioned behind the window is an infrared sensor to detect a change in temperature signaling the presence of an intruder. On the bottom of the cabinet is mounted a mechanical coupling 133 (FIG. 1) for mounting the motion sensor on a tripod 134 similar to the tripod 123 used with the siren pack 65. The motion sensor is equipped with a transmitter for sending a signal to the master control unit when an intruder is detected. The transmitter is similar to the type previously described and can be digitally encoded to identify the specific unit responding to a condition. One or more motion sensors can be positioned about a site to be protected and can be digitally encoded so that the master control knows the precise location where an intruder is present. The motion detector as shown in FIG. 7 would, like the other sensor/transmitter units, be equipped with replaceable or rechargeable batteries.

Figure 8:
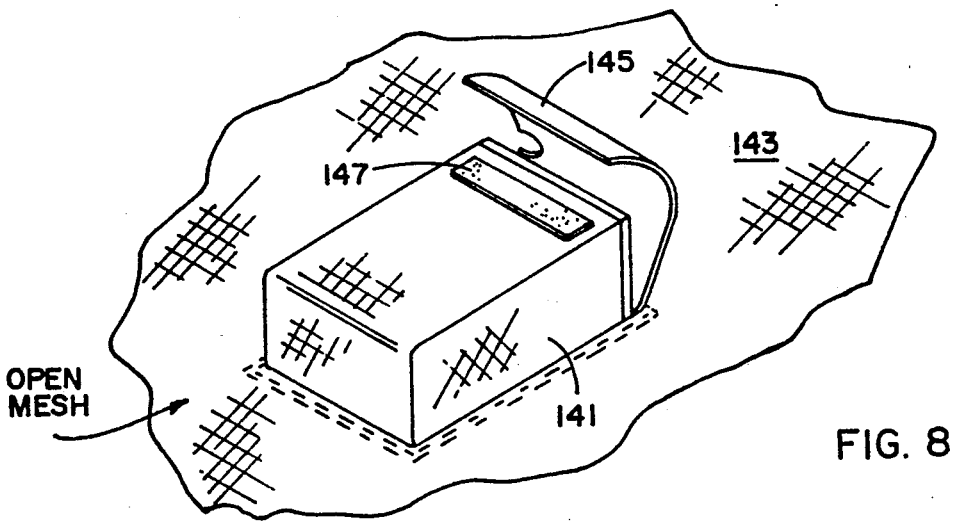
FIG. 8 is a view of a portion of a tarpaulin showing a pocket attached thereto.
Figure 9:
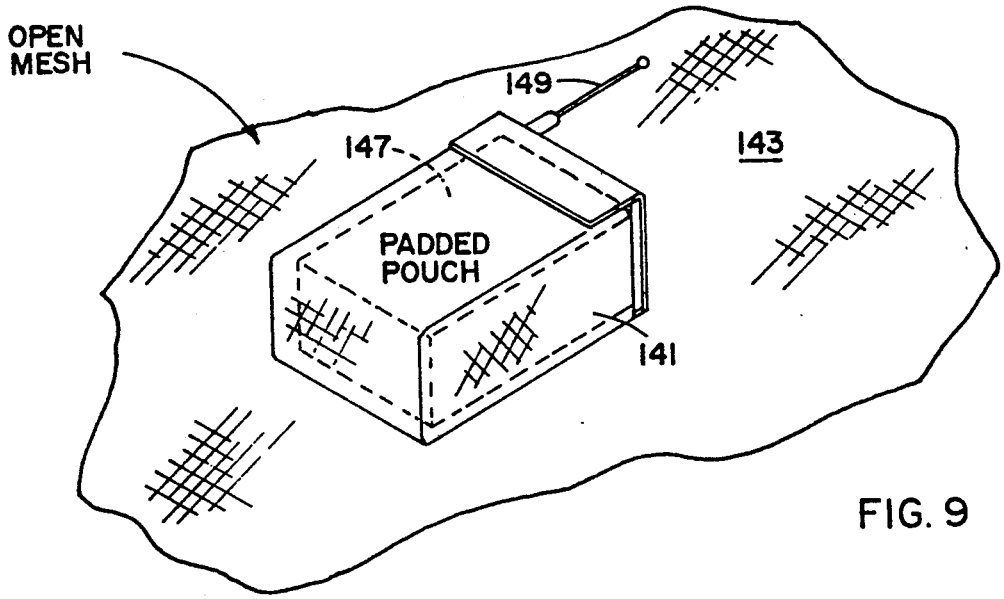
FIG. 9 is a view of a tarp showing a sensor/transmitter in place in the pocket.

In order to protect goods and equipment from theft and vandalism, particularly when the goods or equipment are in a remote location, a sensor unit has been designed for use with a tarpaulin which is used to cover the goods or equipment. As shown in FIG. 8, a pocket 141 is attached to a central portion 143 of a tarpaulin which would be used to cover goods or equipment. The pocket 141 is sewn on three sides and has a cover 145 which can be pulled down tightly and held in place by a Velcro TM fastener 147 which is mounted along the face of the pocket 141 and underneath the edge of the cover 145. As shown in FIG. 9, a sensor/transmitter 147 is shown in phantom mounted inside the pocket 141 with only the antenna 149 extending outwardly. The antenna 149 is a so-called rubber duck type of antenna in that it is flexible and covered with a rubber material to protect it from physical abuse or damage. For added protection, it is preferred to enclose the sensor/transmitter in a padded pouch before installing the unit in the pocket 141.

Figure 10:
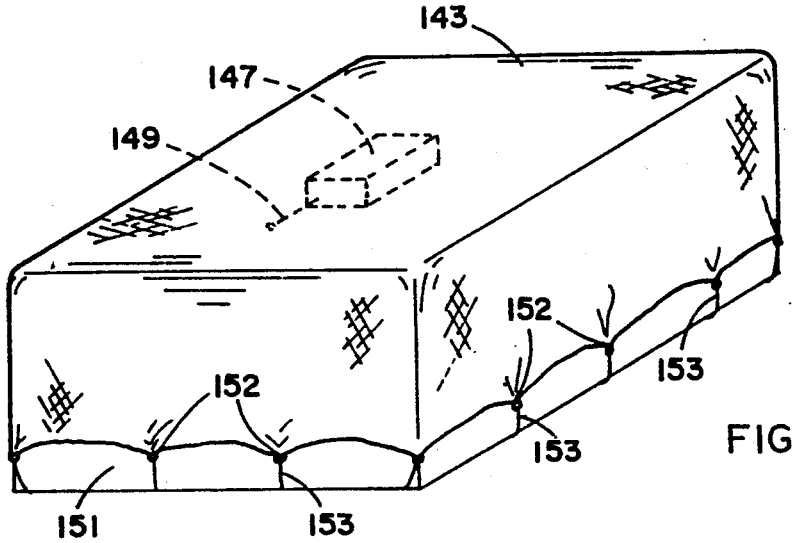
FIG. 10 is a perspective view of a tarp covering goods to be protected and showing in phantom a sensor underneath the tarp.

As shown in FIG. 10, the tarp 143 is shown covering goods 151 which are to be protected from theft or vandalism. The remote sensor/transmitter unit 147 and the antenna 149 are placed below the tarp which is held down tightly on the goods to be protected by a plurality of shock cords 153 attached through grommets 152 in the tarp edge. By fastening the tarpaulin down tightly about the goods to be protected, occasional wind blasts will not trigger the sensor 147. Also, by placing the sensor transmitter under the tarpaulin, any attempt to gain access to the goods or to disable the sensor/transmitter will cause a signal to be sent to the master control unit indicating that something or someone is tampering with the goods 151. The tarpaulin can be a plain color fabric, film, or mesh or can be brightly colored with warning indicia to alert and possibly ward off any thief or vandal.

Figure 11:
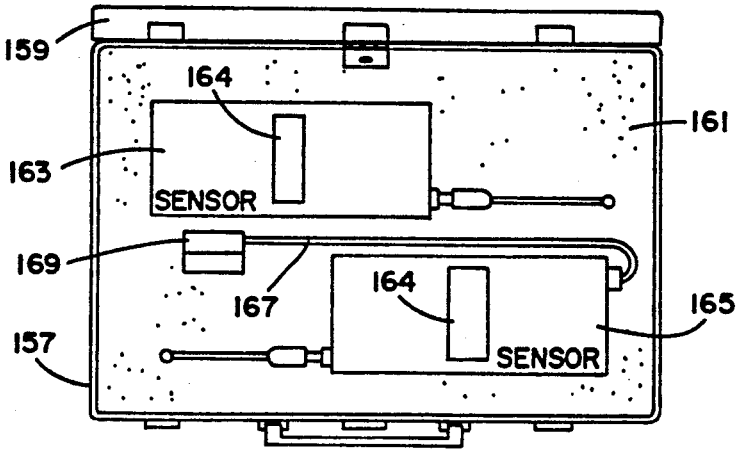
FIG. 11 is a plan view of a carrying case containing part security system.

The security system of the present invention is meant to be transported to a site and to be set up in a matter of minutes. For this purpose and referring to FIG. 11, a rugged case is shown having a bottom portion 157 and a hinged lid 159 with latches thereon for holding it closed to case portion 157. Within the case, foam padding 161 is sculptured so as to safely contain sensor units 163 and 165 and their associated antennas. Sensor unit 165 is slightly different from the sensors described above and is shown with an armored cable 167 leading to a contact sensor 169 which is used to detect the opening and closing of a window or door. Contact sensor 169 is adapted to be applied in two parts with double-faced tape or adhesive. One part is secured to a fixed door jam or the like while the other is secured to the door. If the door is opened, even slightly, the gap created between the two parts changes the electrical signal through cable 167 to activate sensor 165. A suitable gap sensor 169 is commercially sold by Sentrol of Portland, Or, Model 2500 Series. An armored cable is used in this circumstance since the sensor is clearly visible and also is rather small in size. Sensor units 163, 165 may include Velcro TM hook and loop fastener strips 164, adhesive, or other fastener members to secure the sensors on various goods to be protected. Likewise, sensors 23, 25 and 27 may include similar fasteners.

Figure 12:
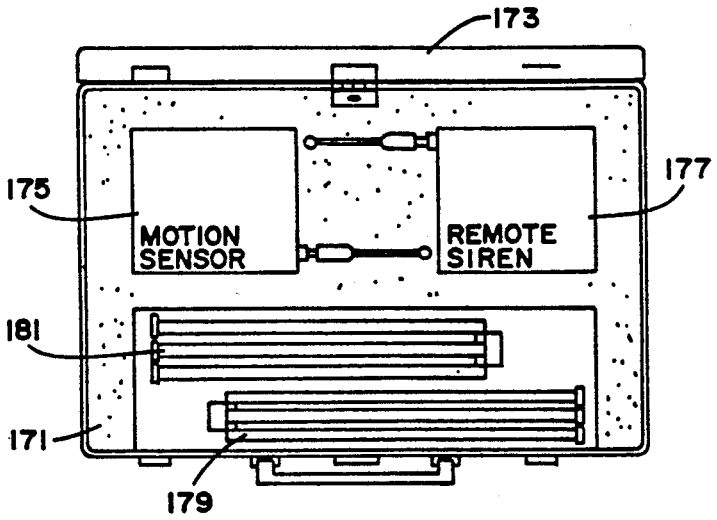
FIG. 12 is another plan view of a carrying case with additional the security system.

In FIG. 12, a case 171 having a hinged lid 173 with latches for holding it closed to case 171 is used to transport a motion sensor 175 and a remote siren pack 177. Also included in the case 171 are tripods 179 and 181 to support the siren pack and motion sensor. The master control has previously been described in FIG. 4 and has its own case 87 with a locking, hinged lid 89. The three cases constituting the portable security system can be carried in the back of a car or truck to a site where they can be opened to gain access to the master control and to gain access to the sensors. The system can then be quickly set up, and the master control unit can test the system before the sensor/transmitter units are left in position and the master control is returned to the spot from which monitoring is to take place.

Figure 13:
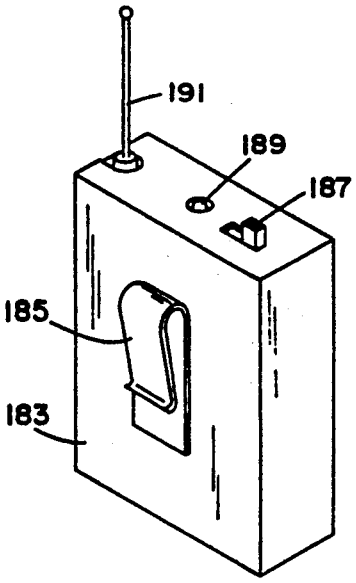
FIG. 13 is a perspective view of a test receiver.

In order to test the security system, after it has been set up, the installer carries on his or her belt a small portable receiver 183, FIG. 13, tuned to the same frequency as the remote alarm unit 65. The test receiver 183 has a belt clip 185 for carrying. An ON/OFF switch 187 controls the operation of the receiver, and a light emitting diode indicator 189 indicates that the signal has been received. The receiver is also equipped with either a telescoping antenna or a rubber duck 191. The receiver can be a single channel receiver decoder from Linear Corporation, Carlsbad, Ca, such as the MR100.

In testing the system, the installer would first test the remote signal unit by activating one of the installed condition-responsive sensors and seeing if the signal is received to activate the siren. Once it has been determined that the remote alarm unit 65 is working, the installer can temporarily disable the alarm unit by disconnecting the battery. The installer can then proceed from sensor to sensor causing a signal to be sent out while watching the LED on the test receiver to see if the activating signal for the remote siren pack is received. After all of the sensor packs have been tested, the battery ca be reconnected in the remote siren pack and the system is ready for operation. The installer can test the entire system without having to leave the remote site.

Though the invention has been described with respect to a specific preferred embodiment thereof, many variations and modifications will immediately become apparent to those skilled in the art. It is therefore the intention that the appended claims will be interpreted as broadly as possible in view of the prior art to include all such variations and modifications.

The embodiments of the invention in which an exclusive property or privilege is claimed are defined as follows:

1. A weather-protected portable security system comprising:

an alarm condition sensor including at least one of an intruder detector (including at least one of a microwave emitter/detector and an infrared sensor) for sensing the presence of a moving object, thing or being; a motion/vibration sensor; a contact sensor to sense a gap opened between two objects and a fire/smoke sensor; and a loop sensor having a weatherproof housing and a pair of electrified wire loops adapted to be connected between a fixed object and an item to be protected and to generate an alarm condition signal if either loop is cut, broken or pulled from said housing;

said alarm condition sensor also including a first radio transmitter in a first weather-protected housing, said transmitter for sending a signal representative of an alarm condition to a remote receiver;

a second weather-protected housing containing;

a radio receiver for receiving the signal from said first transmitter;

a controller for responding to the received signal;

a second ratio transmitter activated by said signal from said controller for sending a signal to a remote alarm device; and a remote alarm device in a third weather-protected housing including a radio receiver for receiving said activating signal from said second transmitter and for sounding an audible alarm is response to said signal, said remote alarm device being located at the same site as said alarm condition sensor.

2. A weather-protected portable security system as set forth in claim 1 wherein said controller can provide a signal to at least one of a digital autodialer, a cellular telephone, and a high-powered transmitter to signal an alarm condition.

3. A weather-protected portable security system as set forth in claim 2 wherein said digital autodialer is in a separate weather-protected housing.

4. A weather-protected portable security system as set forth in claim 2 wherein the digital autodialer is contained in the same housing as the controller.

5. A weather-protected portable security system as set forth in claim 2 wherein the high-powered transmitter is adapted to send a signal reporting an alarm condition to a remote central station.

6. A weather-protected portable security system comprising:

an alarm condition sensor including at least one of an intruder detector (including at least one of a microwave emitter/detector and an infrared sensor) for sensing the presence of a moving object, thing or being; a motion/vibration sensor mounted in a sheet-like cover such that movement of said cover will cause said motion/vibration sensor to generate an alarm signal; a contact sensor to sense a gap opened between two objects; a fire/smoke sensor; and a loop sensor having a weatherproof housing and a pair of electrified wire loops adapted to be connected between a fixed object and an item to be protected and to generate an alarm condition signal if either loop is cut, broken or pulled from said housing; said alarm condition sensor also including a first radio transmitter in a first weather-protected housing, said transmitter for sending a signal representative of an alarm condition to a remote receiver;

a second weather-protected housing containing:

a radio receiving for receiving the signal from said first transmitter;

a controller for responding to the received signal;

a second radio transmitter activated by said signal from said controller for sending a signal to a remote alarm device; and a remote alarm device in a third weather-protected housing including a radio receiver for receiving said activating signal from said second transmitter and for sounding an audible alarm in response to said signal.

7. A portable security system for use in outdoor remote area comprising:

a condition-responsive device located at a monitor site for sensing an alarm condition and for providing an output signal in response to said sensed condition;

a first radio transmitter which is activated by said signal from said condition-responsive device for broadcasting a signal to a master control unit;

a master control unit including a receiver for receiving the signal from said first transmitter, a controller for receiving the signal from said receiver and a second radio transmitter activated by said controller for sending a signal to a remote alarm unit at said monitor site;

a remote alarm unit at said monitored site comprising a receiver for receiving the signal from said second radio transmitter and an alarm device responsive to the signal from said receiver.

8. A portable security system as set forth in claim 7, wherein said master control unit includes at least one of an autodialer and a cellular telephone.

9. A portable security system as set forth in claim 7, wherein said controller can also be used to activate at least one of an autodialer and a cellular telephone for alerting security personnel.

10. A portable security system as set forth in claim 7, wherein said master control unit has battery power supply so that it can be installed independent of power lines.

11. A cover for goods to be protected from theft comprising:

a sheet of material for covering the goods to be protected;

at least one covered pocket disposed on said sheet of material;

at least one motion sensor in said at least one pocket, said motion sensor comprising;

a sensing device for detecting movement of the sheet of material and for generating an electrical signal in response to such movement;

a transmitter for broadcasting a signal to a remote receiver in response to the electrical signal from said sensing device;

a power source for said sensing device and transmitter;

a weatherproof housing for containing said sensing device, said transmitter and said power source; and an antenna for said transmitter disposed on said housing.

12. A cover for goods according to claim 11 wherein when in use, the pocket and sensor are positioned beneath the cover.

13. A cover for goods according to claim 11 wherein said sheet of material is a tarpaulin.

14. A cover for goods according to claim 11 wherein said sheet of material is a tarpaulin.

15. A cover for goods according to claim 11 wherein said sheet of material has an open mesh configuration.

* * * * *

UNITED STATES PATENT AND TRADEMARK OFFICE

CERTIFICATE OF CORRECTION

PATENT NO. : 5,200,735
DATED : April 6, 1993
INVENTOR(S) : Thomas N. Hines

It is certified that error appears in the above-indentified patent and that said Letters Patent is hereby corrected as shown below:

column 3, line 5: after "part" insert --of--;

column 3, line 7: after "additional" insert --parts of--;

column 3, line 36: "Inruder" should be --Intruder--;

column 3, line 45: "switch 3" should be --switch 37--;

column 7, line 13: after "off" insert --a--;

column 9, line 5: "ca" should be --can--;

column 9, claim 1, line 41: "ratio" should be --radio--;

column 10, claim 7, line 32: "area" should be --areas--;

column 10, claim 7, lines 44 & 45: delete "at said monitored site";

column 10, claim 7, line 46: after "unit" insert --at said monitored site--;

column 12, claim 13, lines 6 and 7: delete claim 13 and insert therefor --A cover for goods according to claim 11 including a padded cover for said motion sensor.--

Signed and Sealed this

Fifth Day of April, 1994

Bruce Lehman

*Attest:*

BRUCE LEHMAN

*Attesting Officer*

*Commissioner of Patents and Trademarks*